United States Patent [19]

Schmidt-Balve

[11] 4,003,803

[45] Jan. 18, 1977

[54] CONTROL SYSTEM FOR PREVENTING AN EXCESSIVE TEMPERATURE RISE IN A BATTERY OF COKE OVENS

[75] Inventor: Helmut Schmidt-Balve, Bochum, Germany

[73] Assignee: Dr. C. Otto & Comp. G.m.b.H., Bochum, Germany

[22] Filed: Dec. 3, 1974

[21] Appl. No.: 529,043

[30] Foreign Application Priority Data

Nov. 30, 1973 Germany ..... 2359745

[52] U.S. Cl. ..... 202/262; 202/151; 201/1; 236/15 R; 214/19; 214/23; 214/35 R; 340/282; 340/253 R; 340/309.6; 340/419; 235/151.12

[51] Int. Cl.[2] ..... C10B 21/12; C10B 41/00

[58] Field of Search ..... 202/262, 151; 201/1; 214/18 PA, 23, 355; 236/15 B; 340/282, 419, 253 R, 309.6

[56] References Cited

UNITED STATES PATENTS

| | | | |
|---|---|---|---|
| 1,597,365 | 8/1926 | Keigley et al. | 201/1 X |
| 2,730,707 | 1/1956 | Habeerle et al. | 214/23 X |
| 3,017,622 | 1/1962 | Horsfall | 214/23 X |
| 3,304,241 | 2/1967 | Radcliffe et al. | 202/262 |
| 3,491,356 | 1/1970 | Schuroff | 202/262 X |
| 3,607,660 | 9/1971 | Kumpei | 236/15 B X |
| 3,618,794 | 11/1971 | Helm | 202/262 X |
| 3,875,016 | 1/1975 | Schmidt-Balve et al. | 201/1 X |

*Primary Examiner*—James H. Tayman, Jr.
*Attorney, Agent, or Firm*—Brown, Murray, Flick & Peckham

[57] ABSTRACT

The control system includes a controller and a clocking circuit along with a computer for each one of the coke oven chambers. A first control signal is responsive to the occurrence of charging coal into a given oven chamber and starts the clock. A second control signal is responsive to the pushing of coke from the oven chamber and stops the clock. When the duration of the coking time for a given oven chamber exceeds a predetermined coking time, the controller provides a signal for operating valves to terminate the flow of combustion gases into heating flues at the sides of that coke oven chamber. In the system, the computer updates coking time and establishes from time-to-time from data fed to it, the thermal state of each heating flue in the battery.

7 Claims, 4 Drawing Figures

CONTROL SYSTEM FOR PREVENTING AN EXCESSIVE TEMPERATURE RISE IN A BATTERY OF COKE OVENS

BACKGROUND OF THE INVENTION

This invention relates to a control system for preventing an excessive temperature rise within the heating flues of a battery of coke ovens. More particularly, the control system is designed to adjust the quantity of gas and determine the length of coking time so as to obtain constant flue temperatures over a relatively long period of time without subjecting the brickwork to excessively high operating temperatures.

Developments and effort directed toward increasing the coking capacity of a battery of coke ovens have frequently resulted in an increased temperature of the heating flues such that the maximum temperatures occurring during operation of the battery of coke ovens no longer lies to any great extent below the temperature at which the bricks become softened. Therefore, to insure that the temperature of the heating flues does not rise above an acceptable value, special care must be taken. This is usually achieved by measuring the nozzle brick temperatures in the individual heating flues at short time intervals by observations taken from the oven roof. Such measurements, of course, depend upon the reliability and skill of operators which are assigned the task of taking the temperature measurements.

Methods are already known in the art to protect and avoid the overheating of the battery of coke ovens by measuring in the individual heating flues, the temperature of either the nozzle brick or the flue gas at the top of the reversal zone. The temperature measurement is then fed to a controller which is used to control any one of the values or operating parameters which determine the amount of heat absorbed by the battery, for example, the flue gas flow pressure.

An important influence on the heating flue temperature in the battery of coke ovens is the cycle during which the oven chambers are successively pushed and which should be kept constant as far as possible. However, irregularities invariably occur in the charging and pushing of the oven chambers due to disturbances or malfunctions of the operating equipment for the battery of coke ovens. If the coking time of any given oven chamber is extended very much longer than the normal coking time as a result of such disturbances or malfunctions, then the temperatures in the adjacent heating walls to an oven chamber will after some time exceed those values which are still acceptable in view of the properties of the refractory brick material. Therefore, in the event of malfunctions causing disturbances to the coke pushing sequence, the gas supply must be throttled in the heating walls adjacent the associated ovens or, alternatively, other steps must be taken to prevent the temperatures in these heating walls from exceeding certain maximum values. It is a tenuous matter to have to rely on the skill of operating personnel to take such steps which are required immediately, particularly since the operating personnel are, of course, more likely to omit carrying out the steps required to prevent overheating of the individual flues when disturbances or malfunctions of the type indicated occur.

SUMMARY OF THE INVENTION

It is an object of the present invention to provide a system which, when the coking time of an oven chamber exceeds a given predetermined interval rising out of disturbances to the coke pushing cycle, insures that the heat supply by the associated heating means is throttled for such an oven chamber to prevent temperature increases in the adjacent heating walls above values such as are no longer acceptable in view of the properties of the refractory material forming such walls.

According to the present invention, there is provided a control system for preventing the development of an excessive temperature within the heating flues for coke oven chambers in a battery of coke ovens, which system includes valve means for controlling the flow of combustion gas passed into the heating flues which lie between adjacent coke oven chambers, means responsive to the charging of coal into each oven chamber for producing a first control signal, means responsive to the pushing of coke from each coke oven chamber for producing a second control signal, and controller means including a timer circuit responsive to the first and second control signals for controlling the valve means in a manner to block the flow of combustion gas into the heating flues at opposite sides of a given coke oven chamber when the duration of the coking time of a coal charge therein exceeds a predetermined coking period.

Thus, according to the present invention, means are provided for transmitting and recording a signal or pulse during the charging of an oven chamber and during the subsequent pushing operation of coke from that oven chamber, and controller means operative to bring about a blocking to the gas supply to the two heating flues adjacent the oven chamber if the time elapse between the charging and pushing of an oven chamber exceeds a predetermined coking time by a given amount.

In a simplest form of the control system, a clocking mechanism is provided for each oven chamber and the mechanism is rendered operative and inoperative by a signal pulse occurring upon the charging and by a signal pulse occurring upon the pushing of an oven chamber, whereby after a certain time elapse, the clockwork mechanism energizes a circuit for a switching mechanism that in turn actuates means to turn OFF the gas supply.

The computer is utilized for determining, continuous monitoring and, if required, effecting an automatic change to the elapse time clocked by the clocking mechanism. A computer of this type will be enabled to predict the thermal state of the battery of oven chambers and of each heating flue when there are any departures from the operating data from the original data on the basis of data that is fed into the computer from time-to-time.

The computer will initially receive information data which are measured under a given state of operation of the battery of oven chambers such that it will include the values which determine the underfiring, that is, the amount of gas fed per unit of time, corrected by pressure, temperature and humidity, in $Nm^3/h$, and also the calorific value of the gas measured in kilocalories per $Nm^3$. These values of input data supply information for the determination of the input heat quantity $Q_1$ which has the dimension calories per hour.

The heat withdrawn from the battery of oven chambers is determined from the following data, the flue gas temperature, the oxygen content in the flue gas, the specific coking heat, and the moisture content of the coal. The amount of heat representing the difference between the amount of heat supplied and the amount of heat dissipated serve to provide the heat requirements for the coal charge and to evaporate the moisture contained in the coal.

If the heat utilized by the coking process is less than the amount of heat left over in the battery, that is, if more heat is continuously supplied than is used, then the remaining quantity of heat is utilized for further heating of the brick material.

The primary aim of the present invention will be to control a battery of coke oven chambers by adjusting the quantity of gas supplied and the length of the coking time so as to obtain constant temperatures over a relatively long period of time. Thus, when the data as above-described is fed into a computer, it can be utilized to indicate the value or length of time during which an oven chamber can be continually operated without any risk of endangering the brickwork, provided the appropriate information data concerning the maximum permissible temperatures have been fed into the computer.

By feeding into the computer suitable information data concerning the coking properties of the coal, then the computer can also indicate the pushing cycle. The essential values of data which determine the heat supplied and heat dissipated are advantageously remeasured at intervals of days or weeks and the computer receives the appropriate corrections.

These features and advantages of the present invention as well as others will be more fully understood when the following description is read in light of the accompanying drawings, in which.

Figure 1:
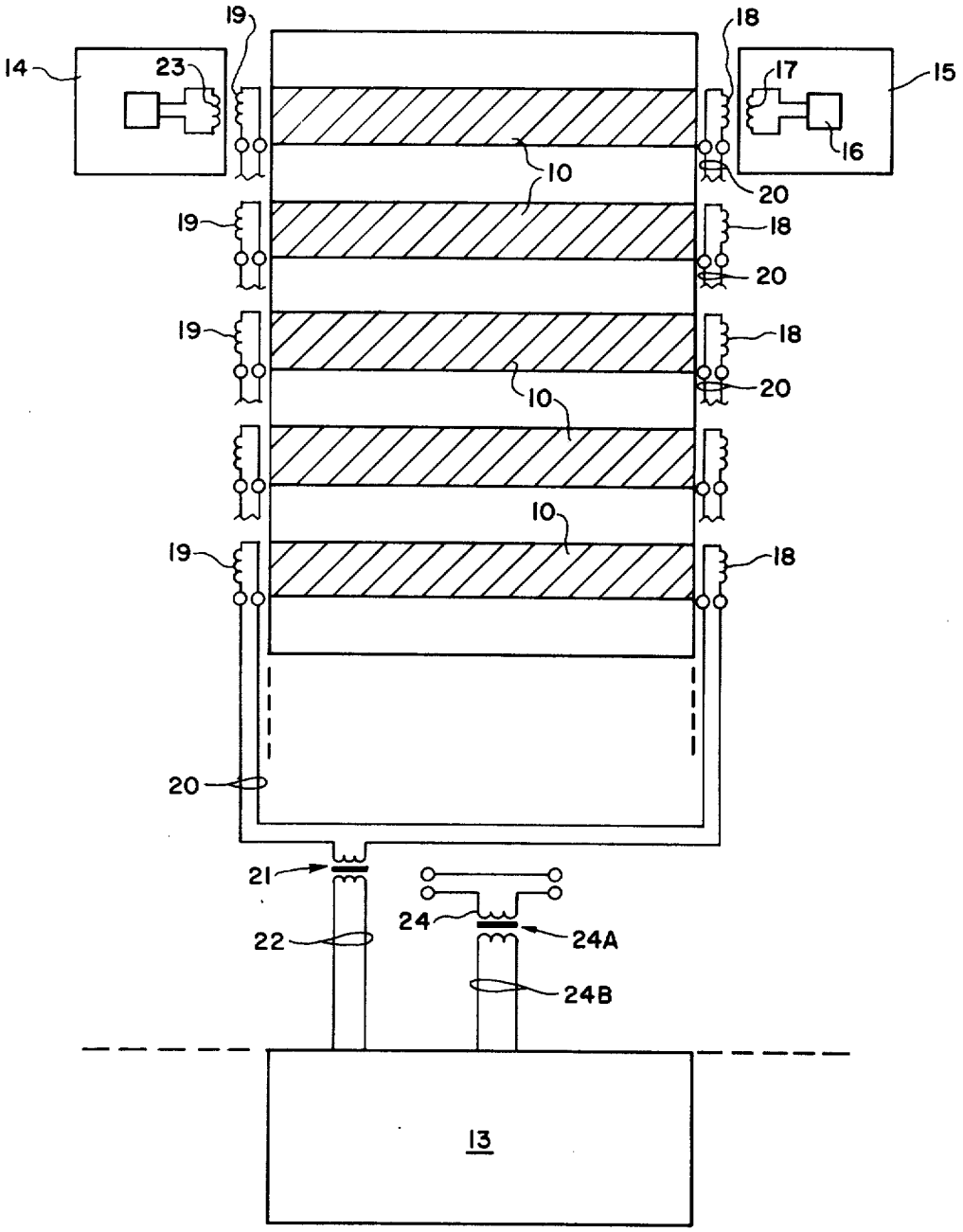
FIG. 1 is a schematic diagram of the control system according to the present invention for use in conjunction with coke oven chambers shown in plan view.
Figure 2:
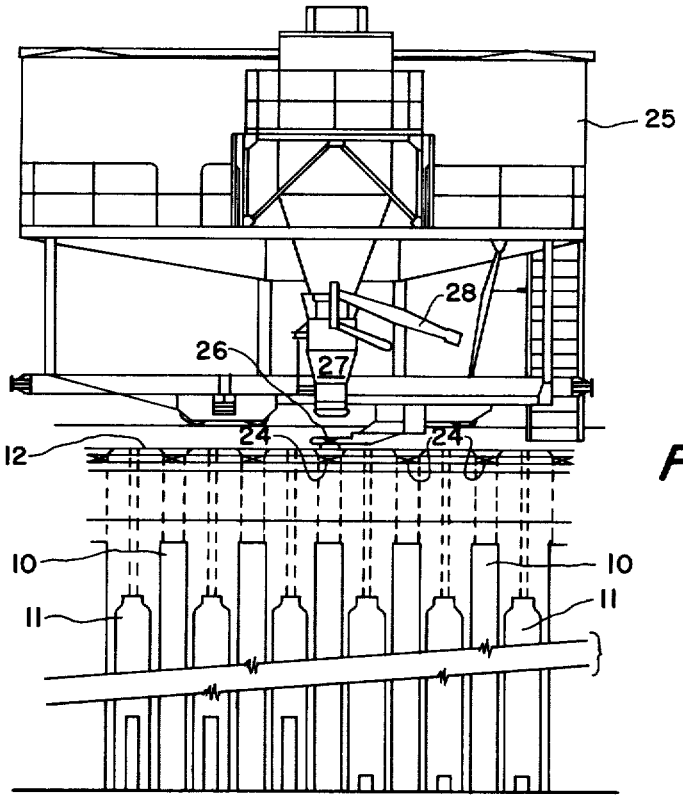
FIG. 2 is an elevational view, partly illustrating a battery of coke oven chambers and the coal charging apparatus.

In FIGS. 1 and 2 of the drawings, there is illustrated a battery of coke oven chambers 10 with a row of heating flues 11 at each side of the oven chambers. An oven roof 12 closes the top of the oven chambers. A computer 13 forms part of a control system for the battery of oven chambers. In FIG. 1, there is illustrated a pushing car 14 which is movable along tracks at the pushing side of the coke oven battery in the usual manner. A door handling car 15 is similarly movable along the battery of coke over chambers but at the coke pushing side. A transmitter 16 is mounted on the door handling car 15 and generates a signal having a frequency of, for example, 5.8 kilohertz. When the door handling car 15 is situated in front of an oven chamber, the energy of the signal generated by the transmitter is transmitted via an inductive antenna 17 on the car to a stationary coil 18 which is provided in front of each of the oven chambers 10. A stationary coil 19 is located at the pusher side of each of the oven chambers which is opposite to the stationary coil 18 at the coke side. The coils 18 and 19 for each separate coke oven chamber are interconnected by a cable 20. This cable is coupled to a transformer 21 having lead wires 22 extending from the secondary winding thereof into the computer 13.

When the pushing car 14 is situated in front of the same coke oven chamber 10 as the door handling car 15, the transmission energy received in the coil 18 is conducted by the corresponding coil 19 to the receiver coil 23 on the pusher car. Thus, operating personnel on the pusher car are informed that the pusher is located in front of the correct oven chamber from which coke is to be pushed. At the same time, the computer 13 receives an electrical signal via transformer 21 and leads 22 indicating that the oven chamber is being pushed as given by the concurrent location of the door handling car and pusher car at opposite sides of that oven chamber. In this way, the pushing time of the oven chamber is defined.

The computer also receives an electrical signal produced in a similar way indicating that an oven chamber is undergoing a coal charging operation. Thus, as shown in FIG. 2, a separate induction coil 24 is provided in the oven roof 12 above each oven chamber 10. Mounted on a charging car 25 is a transmission coil 26 which is energized when the charging hopper closure member 27 is opened by means of linkage 28. When this occurs the coil 26 and a coil 24 are inductively coupled. Each induction coil 24, one of which is shown in FIG. 1, delivers a signal pulse through an individual transformer 24A having its secondary winding connected by leads 24B to the computer 13. In this way, an electrical signal is delivered to the computer indicating the occurring event of charging each individual oven chamber with coal.

Figure 3:
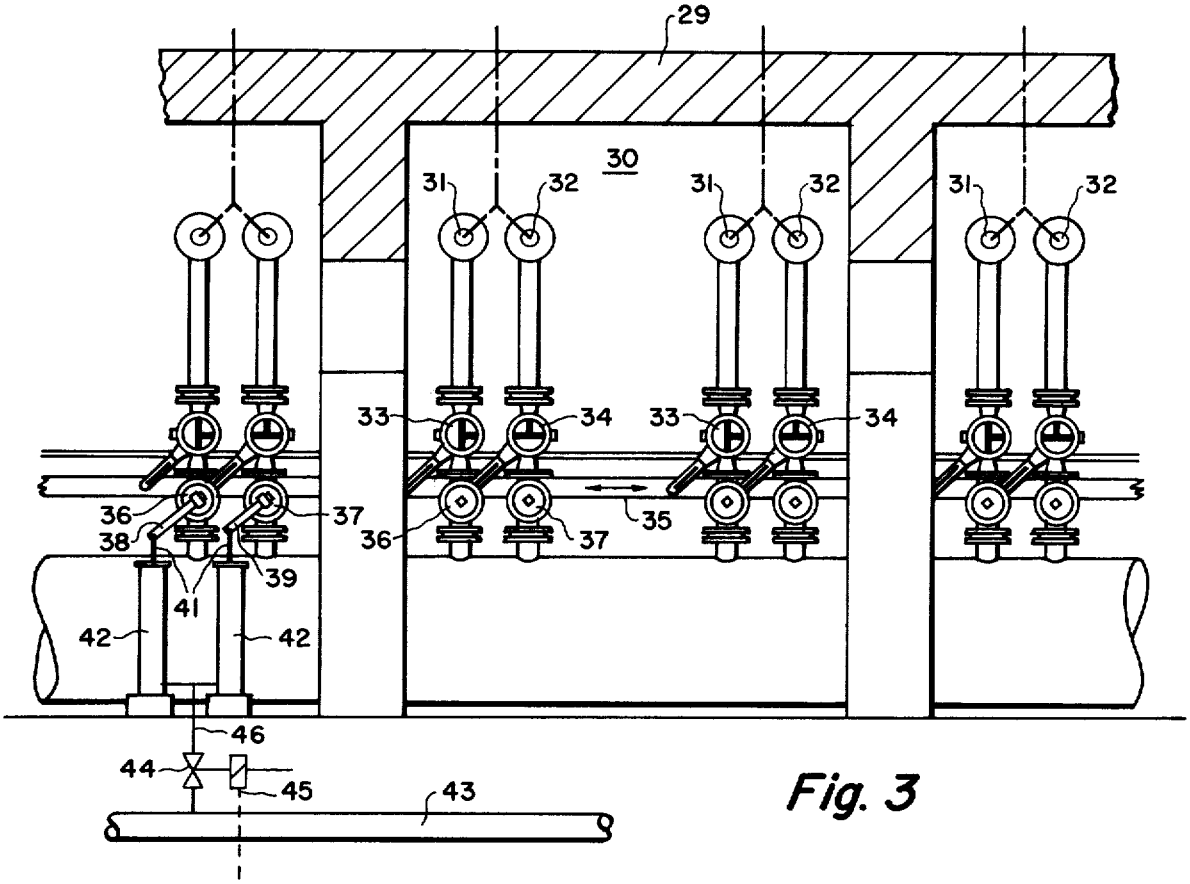
FIG. 3 illustrates the pipeline arrangement of the supply of rich gas to the coke oven chambers including the valves for adjusting and terminating the flow of gas to the individual heating walls.

In FIG. 3, there is illustrated the concrete roof 29 above the oven cellar 30. Nozzle pipelines 31 are connected to a rich gas supply and conduct such rich gas during one regenerative half-cycle to the heating flues. Nozzle pipelines 32 are fed with gas during the other half-cycle. Valves 33 and 34 are operatively coupled to a linkage 35 by which the valves are operated for the changeover of a gas supply from one pipeline to the other. Turn-off valves 36 and 37 determine the delivery gas to the valves 33 and 34, respectively, from a pipeline system 40. The turn-off valves 36 and 37 have levers 38 and 39, respectively, which are coupled to the rod ends 41 of separate piston and cylinder assemblies 42. Pipeline 43 supplies compressed air through a three-way solenoid valve 44 controlled by the computer 13 for delivery by line 46 to the piston and cylinder assemblies 42. The electrical signal from the computer 13 is delivered over line 45 to energize the solenoid mechanism of the valve 44, thus opening the valve for delivery of the compressed air from line 43 to the piston and cylinder assemblies 42 whereby the pistons thereof are extended out of the cylinders. This positions the valves 36 and 37 into a closed position and terminates the gas supplied to the two heating flues that lie at the sides of a given oven chamber. By this arrangement of parts, should the critical period between the charging operation and the pushing operation for any given oven chamber exceed the maximum permissible or desired coking times, then the valves 36 and 37 are closed to stop the flow of gas and thereby the supply of heat to that oven chamber by the adjacent heating flues. When the signal in line 45 is terminated by the computer, the solenoid valve 45 is again opened which, in turn, opens the chamber of the piston and cylinder assembly to the atmosphere. The compressed air can, therefore, escape and a spring acting on the piston rod 45 urges the piston into a position which again reopens the valves 36 and 37 for the supply of gas into the heating flues.

Figure 4:
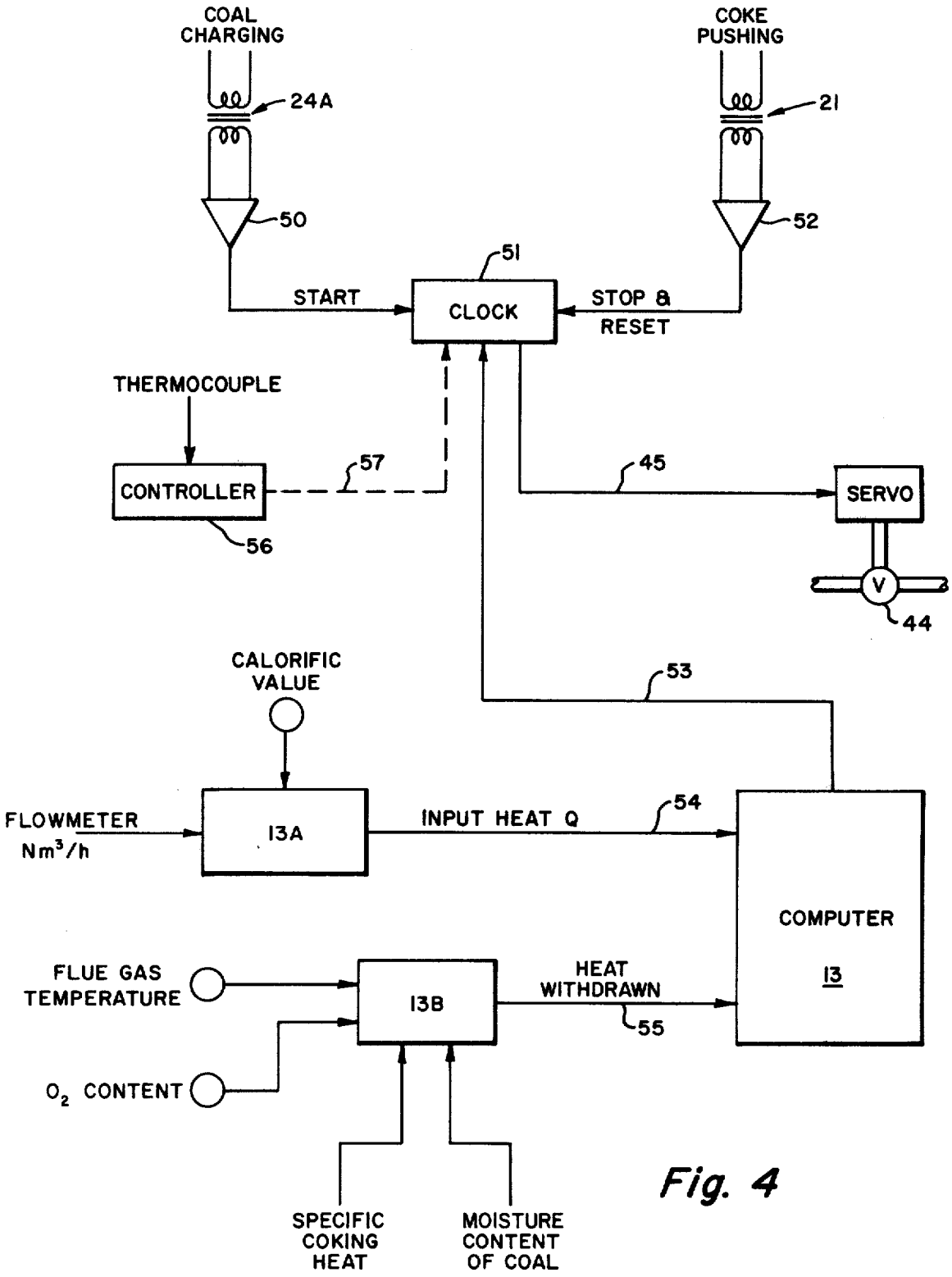
FIG. 4 is a schematic illustration of the control system according to the present invention.

In FIG. 4, there is illustrated in greater detail, a particular form of control system embodying the features of the present invention. It will be understood, of course, that this is a simplified form of control system for any given one of the oven chambers and that for each oven chamber a similar control system will be provided. A signal pulse from the coal charging car is sent through transformer 24A to a pulse producing amplifier 50. The output from amplifier 50 forms a clock starting pulse which is fed to a clock 51. The clock is stopped and reset by the pulse output from a pulse producing amplifier 52 that is coupled to the leads of transformer 21 which receives a signal at a time when the coke oven chamber is undergoing a pushing operation as previously described. Should the clocked period of time set by the clock 51 expire before there occurs a stop and reset signal from transformer 21, then a control signal is set over line 45 for energizing the servo device associated with valve 44 as previously described to terminate the flow of gas into the heating flues at the sides of the ovenchamber. The computer 13 is utilized in the control system for determining, continuous monitoring and automatic changes to the coking period set by the clock 51. Thus, the computer supplies a corresponding electrical signal over line 53 to the clock. The computer receives input signals over lines 54 and 55. The signal in line 54 corresponds to the heat input $Q_1$ and it is a computed signal by a computer subsystem 13A into which there is fed signals which include the output signal from the flow meter to indicate the amount of gas fed per unit of time corrected by pressure temperature and humidity in units of $Nm^3/h$. The computer section 13A also receives a signal corresponding to the specific calorific value of the gas measured in terms of kilocalories per $Nm^3$. The amount of heat withdrawn and utilized by the coking process is computed by a computer section 13B and delivered over lines 55. Computer section 13B receives the following input data: the flue gas temperature, the oxygen content of the flue gas, the specific coking heat and the moisture content of the coal. Based on the input information to the computer 13 over lines 54 and 55, it provides a signal in line 53 to the clock for adjusting the gas supply and the length of coking time so as to obtain constant temperatures over a relatively long period. The computer, as previously indicated, can be utilized to provide a readout representing the time during which the coke oven chamber can continue the coking operation above a predetermined desired coking period without endangering the brickwork. From what has already been said, it will be understood by those skilled in the art that if the heat withdrawn by the coking process is less than the amount of heat left over in the battery, that is, if more heat is continuously supplied than used, the remaining quantity of heat serves to heat the brick material further. It is essential that such temperature increases to the refractory brick must remain within acceptable limits in view of the properties of the refractory brick material. The essential values used to determine the heat supplied and heat dissipated are preferably remeasured at suitable intervals of days or weeks whereby the computer receives the appropriate updating corrections.

FIG. 4 also illustrates an alternative manner by which a time changing signal may be supplied to the clock 51. In this respect, a controller 56 receives the output signal from a thermocouple embedded within the brickwork of the heating flue so as to provide appropriate data concerning the temperature of the brickwork to the controller which, in turn, provides a control signal in line 57 to the clock 51. In the absence of a stop and reset signal from transformer 21, the clock 51 will provide a control signal in line 45 to the servomechanism for the valve 44 in the manner already described.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A control system for preventing the development of an excessive temperature within heating flues for individual coke oven chambers in a battery of coke ovens, said control system including:

valve means for controlling the flow of combustion gas into the heating flues located at the sides of a given coke oven chamber, means responsive to the charging of coal into the given coke oven chamber for producing a first electrical signal, means responsive to the pushing of coke from the given coke oven chamber for producing a second electrical signal, means responsive to the amount of heat fed into the given coke oven chamber for producing a third electrical signal, means responsive to the amount of heat yielded from flues at the sides of the given coke oven chamber for producing a fourth electrical signal, means for producing a fifth electrical signal which varies in response to a comparison of the actual temperature rise in heating flues for the coke oven chamber with a predetermined acceptable temperature in the heating flues during a desired coking period and determined in relation to the properties of the refractory material forming the heating flues, and controller means including a timer circuit to clock a predetermined coking period for a coal charge in the given coke oven chamber, said timer circuit being responsive to said first and second electrical signals to control said valve means in a manner to block the flow of combustion gas into the heating flues at the sides of the given coke oven chamber when the clocked duration of the coking time for a coal charge therein exceeds a predetermined coking period, said controller means being responsive to a signal produced by means receiving said third, fourth and fifth electrical signals for computing a maximum duration to the coking period by the coke oven chamber.

2. The control system according to claim 1 wherein said means for producing a second electrical signal include inductive means at the pushing side and the coke side of the oven chamber.

3. The control system according to claim 1 wherein said means for producing a second electrical signal include stationary inductive means at the pushing side and the coke side of the oven chamber, transformer means coupled by a cable to the inductive means at the sides of the oven chamber, a movable receiver coil at one side of the coke oven and a movable transmitter at the other side of the coke oven for producing a signal by said transformer means to indicate that the movable receiver and movable transmitter are positioned at opposed sides of the same coke oven chamber.

4. The control system according to claim 1 wherein said means for producing a first electrical signal include coal charging means including an inductive member movable therewith along the roof of the battery of coke ovens into position above each coke chamber, and stationary inductive means above each coke oven chamber in the roof for the coke ovens for inductive coupling with said inductive member to thereby produce said first electrical signal indicative of charging coal into a given oven chamber.

5. The control system according to claim 1 wherein said means for producing a third electrical signal is responsive to the input quantity of heat to the heating flues at the opposite sides of the coke oven chamber, said means responsive to said third, fourth and fifth electrical signals further computing an extension period to the coking period for the continued coking operation by the oven chamber without development of an endangering temperature to the refractory brick of the heating flues.

6. The control system according to claim 5 wherein said timer circuit is coupled for response to an electrical signal corresponding to the computed extension period of time by said means for computing.

7. The control system according to claim 1 wherein said controller means further includes a servo actuating device responsive to a control signal from said timer circuit for controlling said valve means.

* * * * *